United States Patent [19]

Giusti

[11] 4,199,266

[45] Apr. 22, 1980

[54] PROCESSING VESSELS

[76] Inventor: Raolo B. Giusti, 28 Allandale Ave., Finchley, London N3 3PJ, England

[21] Appl. No.: 6,890

[22] Filed: Jan. 26, 1979

Related U.S. Application Data

[63] Continuation-in-part of Ser. No. 829,434, Aug. 31, 1977, abandoned.

[51] Int. Cl.[2] ..... B01F 7/04

[52] U.S. Cl. ..... 366/296; 99/348; 366/312

[58] Field of Search ..... 366/279, 296, 311, 312, 366/313; 99/348

[56] References Cited

U.S. PATENT DOCUMENTS

| | | | |
|---|---|---|---|
| 2,753,158 | 7/1956 | Rebechini | 99/348 X |
| 3,752,057 | 8/1973 | Groen, Jr. | 366/312 X |

FOREIGN PATENT DOCUMENTS

| | | | |
|---|---|---|---|
| 1025893 | 4/1966 | United Kingdom | 366/312 |

*Primary Examiner*—Philip R. Coe

*Attorney, Agent, or Firm*—Parmelee, Miller, Welsh & Kratz

[57] ABSTRACT

A processing vessel for mixing a liquid containing solid pieces comprises a container having a top opening and a hemispherical bottom portion, a horizontal or inclined agitator drive shaft extending into the container and a substantially circular agitator mounted on the drive shaft for rotation therewith. The agitator comprises a pair of substantially annular semicircular blades, each formed with an internal segment-shaped web and carrying at its outer periphery a plurality of scrapers which are shaped to conform to the shape of the hemispherical bottom portion of the container and are attached to the blade so as to be capable of limited pivotal movement. First and second coaxial agitator drive shafts may be provided, each shaft carrying a respective part of a two-part agitator.

7 Claims, 5 Drawing Figures

PROCESSING VESSELS

This application is a continuation-in-part of application Ser. No. 829,434 filed Aug. 31, 1977, now abandoned.

BACKGROUND OF THE INVENTION

This invention relates to a processing vessel for use inter alia in the processing of materials in the food, pharmaceutical and cosmetic industries.

One of the operations which such a vessel is required to perform is the agitation of a liquid containing pieces of solid material. Such agitation is performed by rotating an agitator within the vessel.

Known processing vessels employ agitators which are rotated about a vertical axis and such agitators, unless functioning at high speed, permit settling and do not effectively distribute the solid pieces in the liquid. Moreover, the known agitators exert a considerable shearing effect on the mixture end, where the solid pieces are of a sensitive material which is easily fragmented, this strenuous shearing effect results in the degradation of the solid pieces rather than the even distribution of the original solid pieces in the liquid which is desired.

SUMMARY OF THE INVENTION

It is an object of the present invention to provide a processing vessel for mixing pieces of a solid in a liquid without undue degradation of the solid pieces.

Accordingly, the present invention provides a processing vessel for mixing a liquid containing solid pieces, comprising: a container for receiving the material to be processed, said container having a top opening and a hemispherical bottom protion; a non-vertical agitator drive shaft extending into the container; motor means for rotating said agitator drive shaft means; and agitator means disposed on said drive shaft means and being adapted to engage and scrape the surface of the hemispherical bottom portion of said container; said agitator means being substantially circular in form and comprising a pair of substantially semicircular annular blades extending around a frusto-conical surface having an axis which extends radially of said agitator drive shaft means and passes through the center of the circle; said semicircular annular agitator blades providing a continuous surface area on which solid pieces adjacent the bottom of the vessel are picked up and elevated to the upper part of the vessel where they are discharged; said frusto-conical shape of each blade causing the surface of the blade to be inclined to the vertical as it passes through its lowermost position so that the blade exerts a relatively gentle scooping action on the solids adjacent the bottom of the vessel.

BRIEF DESCRIPTION OF THE DRAWINGS

In order that the invention may be readily understood, embodiments thereof will now be described, by way of example, with reference to the accompanying drawings in which.

DESCRIPTION OF PREFERRED EMBODIMENTS

Figure 1:
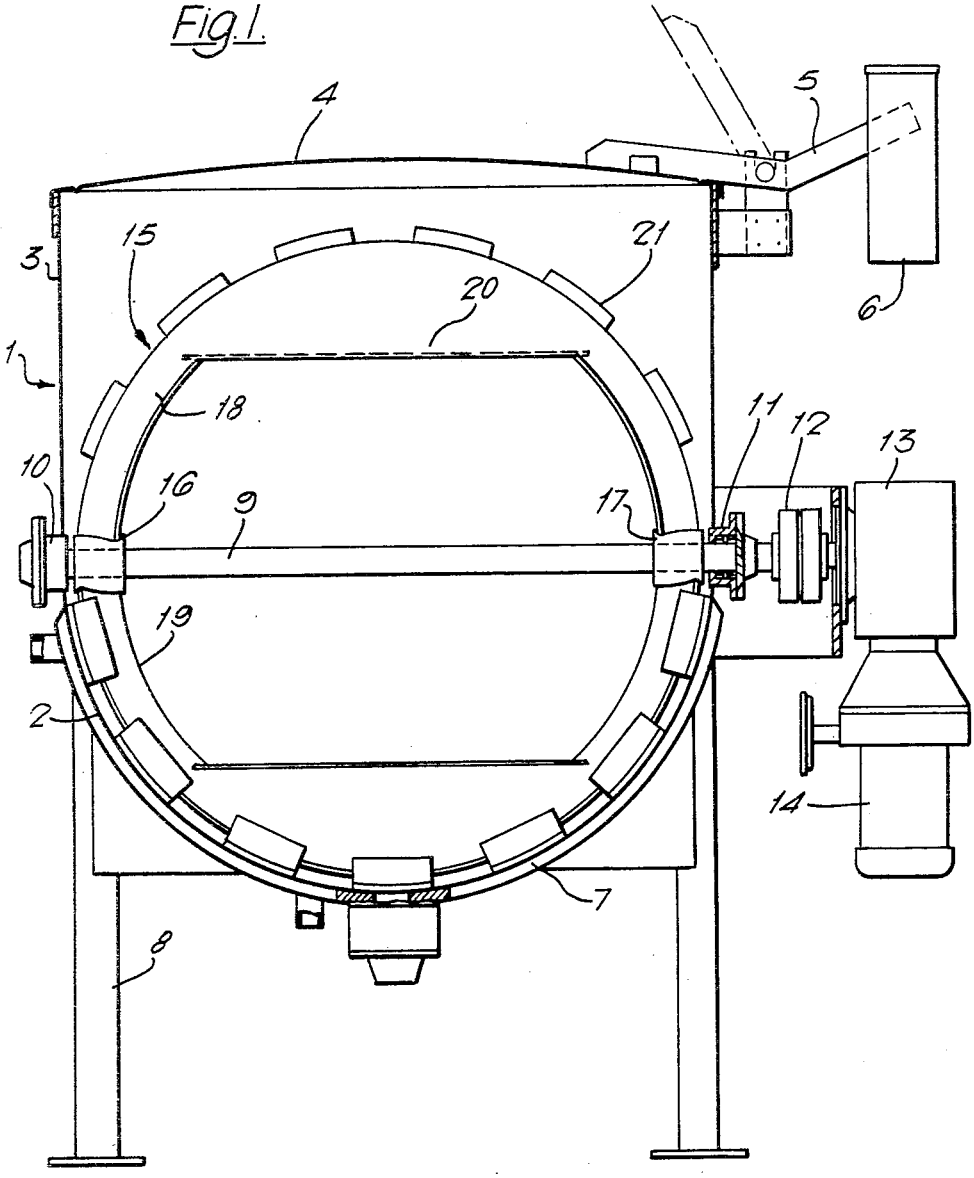
FIG. 1 is a diagrammatic side elevation, partly in cross-section, of a first processing vessel embodying the invention.
Figure 2:
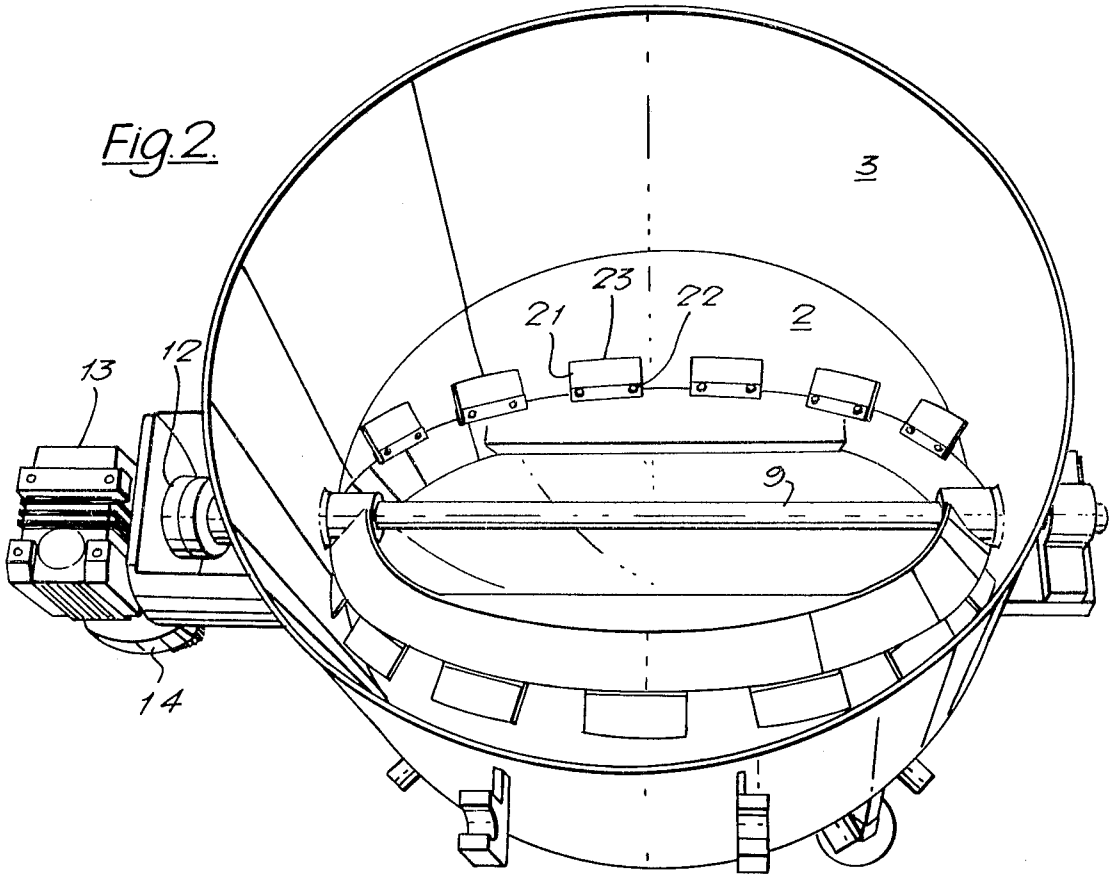
FIG. 2 is a top perspective view of a vessel constructed in accordance with FIG. 1, the vessel being shown without its lid.

Referring to FIGS. 1 and 2, a processing vessel embodying the invention comprises a container 1 for receiving material to be processed. The container 1 has a hemispherical bottom portion 2 and a cylindrical top portion 3 provided with a top opening. A hinged and slightly domed lid 4 for closing the top opening of the container 1 is mounted on an operating lever 5 which is pivotally mounted on the upper portion 3 of the container and which carries a counterweight 6 for retaining the lid 4 in the open position.

The hemispherical bottom portion 2 of the container only is provided with a jacket 7 through which a heating or cooling medium can be circulated to heat treat the material in the container. The container is supported on four equally spaced tubular legs 8, only two of which appear in FIG. 1.

A horizontally extending agitator drive shaft 9 passes diametrically through the container 1 in the upper portion 3 of the container adjacent to the junction of the container portions 2 and 3, the shaft being rotatably supported and sealed at the two places where it passes through the wall of the container by respective bearings 10 and 11. Outside the container 1, the shaft 9 is connected via a coupling 12 to a gearbox 13 driven by an electric motor 14.

A substantially circular agitator 15, adapted to engage and scrape the surface of the hemispherical bottom portion 2 of the container 1, is mounted on the shaft 9 in the interior of the container 1, the agitator comprising a pair of mounting sleeves 16 and 17 through which the shaft 9 passes and which are provided with lock screws (not shown in FIG. 1) for securing the agitator to the shaft.

The agitator 15 has a pair of substantially semicircular annular blades 18 and 19 formed integrally with the mounting sleeves. The blades 18 and 19 are inclined in opposite directions with respect to the general plane of the agitator 15, each blade extending around a respective frusto-conical surface having an axis which extends radially of the shaft and passes through the centre of the agitator.

A central segment-shaped web 20, lying in the general plane of the agitator is provided on the inside of each blade of the agitator, the web 20 having an inner straight edge provided with a flange extending perpendicularly to the plane of the web. Scrapers 21 are provided at the outer periphery of each blade, the scrapers 21 being attached to the agitator blades by bolts 22 which allow an adjustable limited pivotal movement of the scrapers. The outer edge 23 of each scraper is curved to conform to the spherical portion 2 of the vessel.

In use of the vessel shown in FIGS. 1 and 2, rotation of the agitator 15 at very slow speed produces effective distribution of solid pieces in a liquid, the solid pieces being gently lifted on the blades and web from the lower part of the vessel to the upper part of the vessel where they are released. The shearing action of the blades is minimal, thereby reducing degradation of the solid pieces to a minimum. The whole of the interior surface of the lower part of the vessel, which is surrounded by the heat treatment jacket, is scraped by the scrapers on the agitator blades to avoid build-up of material and to give maximum heat transfer.

The form and shaping of the agitator provides highly satisfactory mixing of fragile solid pieces in a liquid without undue degredation of the solid pieces. Thus, the use of semicircular annular agitator blades provides a large continuous surface area on which the solid pieces adjacent the bottom of the vessel are picked up and elevated to the upper part of the vessel where they are discharged. The frusto-conical shape of each blade is such that the surface of the blade is inclined to the vertical as it passes through its lowermost position and thereby exerts a relatively gentle scooping action on the solids adjacent the bottom of the vessel. The orientation of the blade surface during the first part of its upward movement is substantially horizontal, so that the solid pieces picked up from the bottom of the vessel are elevated to the upper part of the vessel where they are gently discharged from the blade as the blade becomes increasingly inclined to the vertical.

Figure 3:
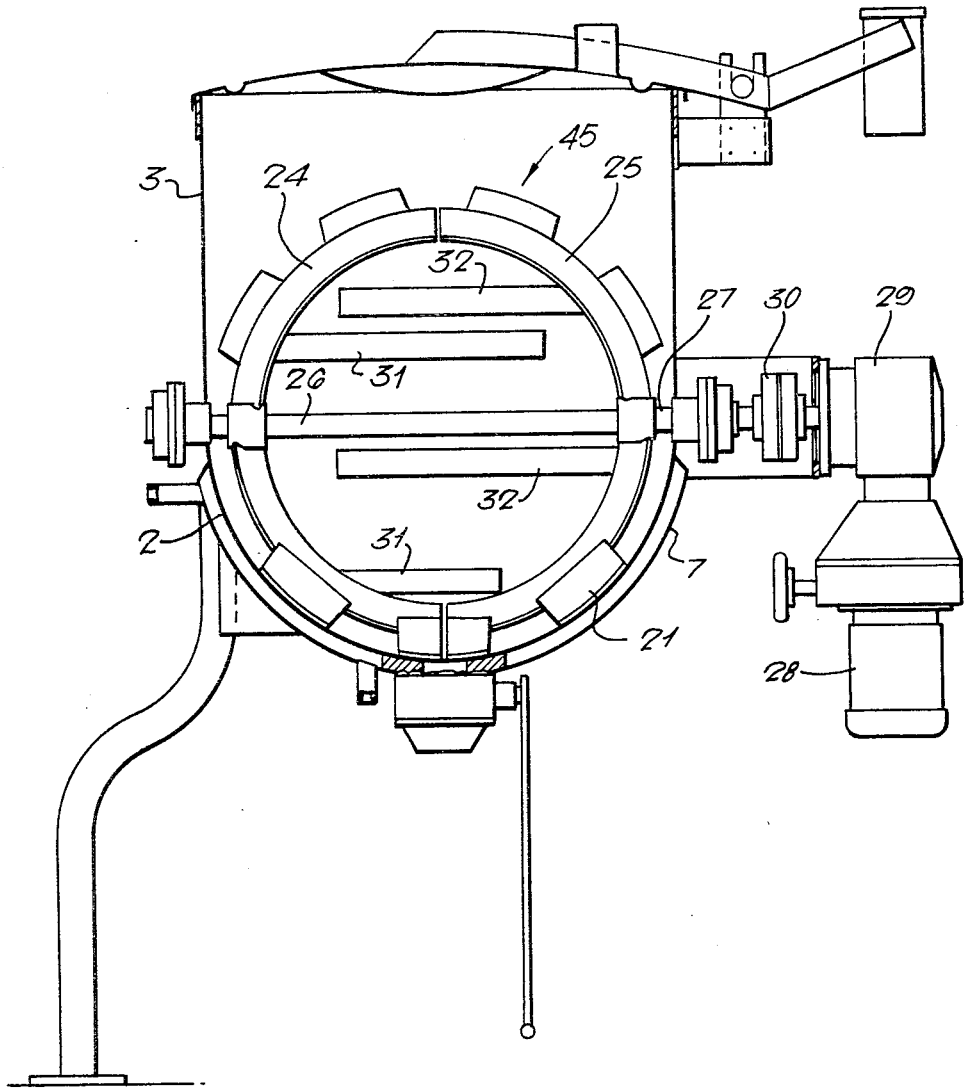
FIG. 3 is a diagrammatic side elevation, partly in cross-section, of a second processing vessel embodying the invention.

FIG. 3 illustrates another vessel embodying the invention which is similar to the embodiment already described with reference to FIGS. 1 and 2, except that the circular agitator is divided radially of the axis of rotation into first and second agitator parts 24 and 25 which are rotated in opposite directions. To this end the agitator parts 24 and 25 are fixed to respective coaxial drive shafts 26 and 27 which are rotated in opposite directions by motor 28 via gearbox 29 and 30. To enhance the mixing action, the agitator parts 24 and 25 of FIG. 3 are provided with intermeshing axially extending straight blades 31 and 32 which also lie substantially in the plane containing the axis of the drive shaft and the circular agitator parts.

Figure 4:
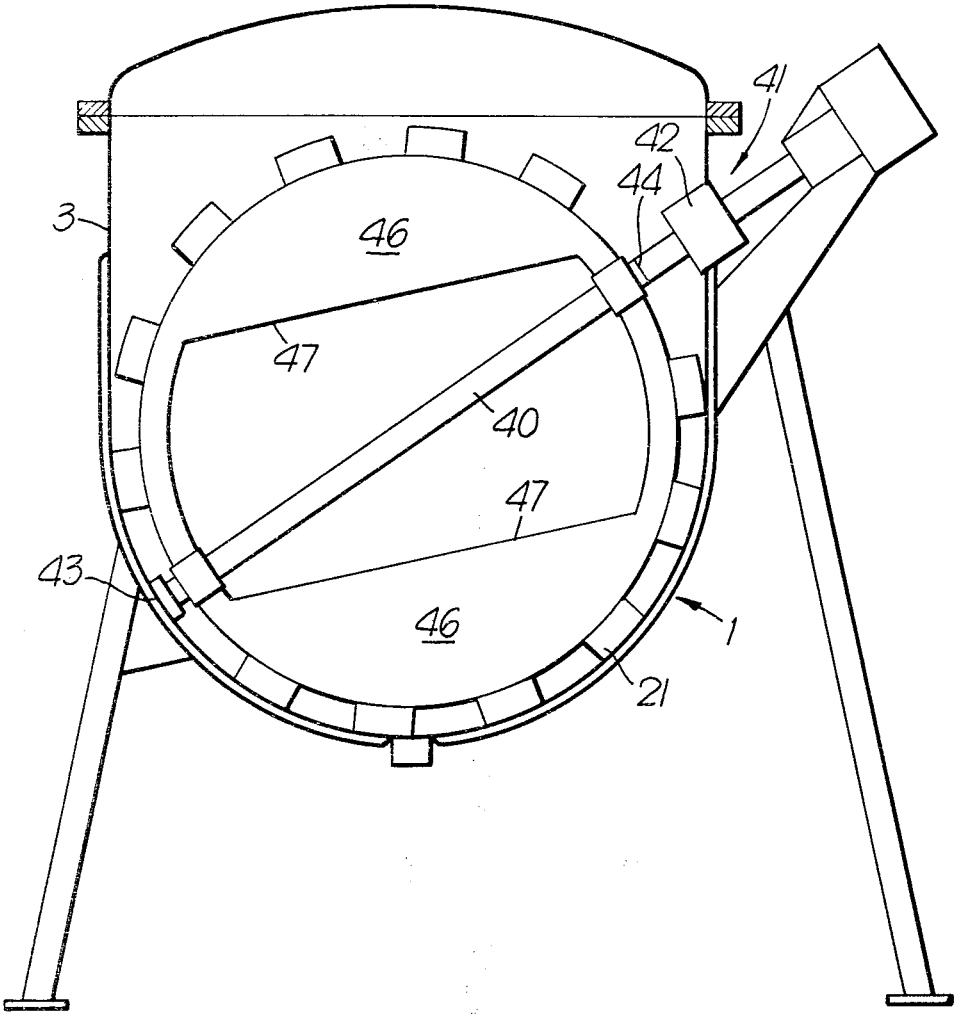
FIG. 4 is a diagrammatic side elevation, partly in cross-section, of a third processing vessel embodying the invention.

FIG. 4 illustrates a third vessel embodying the invention, in which an inclined agitator drive shaft 40 extends diametrically into the container 1 in the upper portion 3 of the container. The shaft 40 is rotatably supported and sealed at an upper place 41 where it passes through the wall of the container by a hygenic mechanical bearing 42. The shaft 40 is also rotatably located by a lower internal bearing 43 mounted on the container wall and comprising a welded ring with a teflon brush with slots to enable cleaning. The shaft 40 may comprise two parts connected together, eg. by screwing, at 44 to enable the whole agitator to be removed for cleaning.

The circular agitator of the FIG. 4 embodiment is substantially similar to the agitator 15 of FIG. 1, except that the segment-shaped webs 46 are displaced around the semicircular blades towards respective ends of the shaft so as to bring the edges 47 of the webs closer to horizontal.

Figure 5:
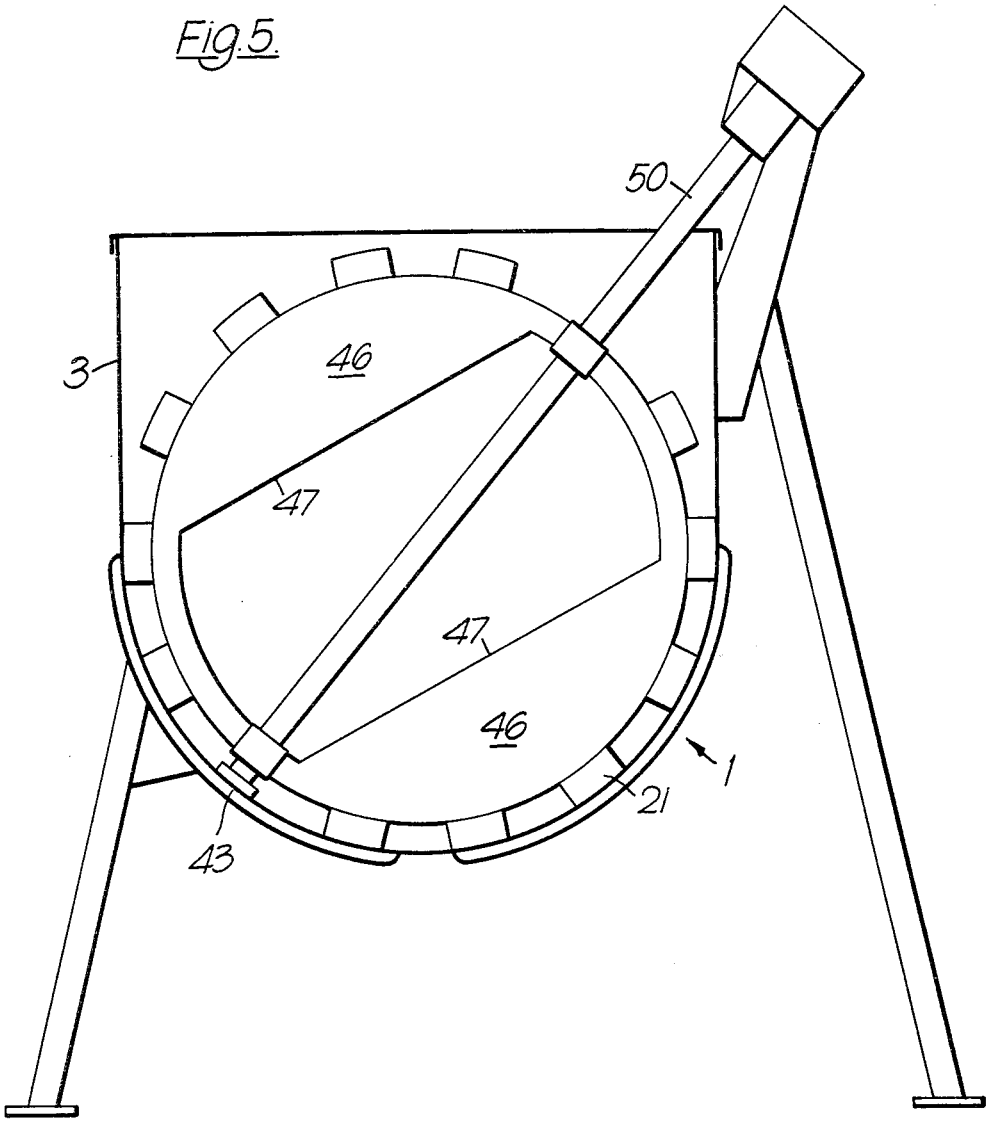
FIG. 5 is a diagrammatic side elevation, partly in cross-section, of a fourth processing vessel embodying the invention.

FIG. 5 shows a fourth embodiment of the invention which is substantially similar to that of FIG. 4, except that the drive shaft 50 extends freely into the vessel through the top opening of the vessel.

It is envisaged that a vessel embodying the invention may be provided with a lid of sealing-tight construction if the material is to be processed under pressure or vacuum.

I claim:

1. A processing vessel for mixing a liquid containing solid pieces, comprising:

a container for receiving the material to be processed, said container having a top opening and a hemispherical bottom portion;

a non-vertical agitator drive shaft extending into the container;

motor means for rotating said agitator drive shaft; and agitator means disposed on said drive shaft for engaging and scraping the surface of the hemispherical bottom portion of said container;

said agitator means being substantially circular in form and comprising a pair of substantially semicircular annular blades extending around a frusto-conical surface having an axis which extends radially of said agitator drive shaft and passes through the centre of the circle;

said semicircular annular agitator blades providing a continuous surface area on which solid pieces adjacent the bottom of the vessel are picked up and elevated to the upper part of the vessel where they are discharged;

said frusto-conical shape of each blade causing the surface of the blade to be inclined to the vertical as it passes through its lowermost position so that the blade exerts a relatively gentle scooping action on the solids adjacent the bottom of the vessel.

2. A vessel as claimed in claim 1, wherein each of said blades is provided with a central internal segment-shaped web lying in the general plane of said agitator means.

3. A vessel as claimed in claim 1, wherein the outer periphery of each of said blades carries a plurality of scrapers, each of said scrapers being shaped to conform to the shape of said hemispherical bottom portion of said container and being attached to said blade by means permitting a limited pivotal movement of said scraper.

4. A vessel as claimed in claim 1, wherein said agitator drive shaft means comprises first and second coaxial drive shafts, said motor means being operative to rotate said first and second coaxial drive shafts in opposite directions, said semicircular annular blades being axially spaced apart along said agitator drive shaft and each being mounted for rotation with a respective one of said first and second drive shafts.

5. A vessel as claimed in claim 1, wherein said agitator drive shaft means extends horizontally through the wall of said container, sealing means being arranged to support said agitator drive shaft means rotatably and sealingly where said drive shaft means passes through the wall of said container.

6. A vessel as claimed in claim 1, wherein said agitator drive shaft means extends at an inclination to the vertical through the wall of said container, sealing means being arranged to support said agitator drive shaft means rotatably and sealingly where said drive shaft means passes through the wall of said container.

7. A vessel as claimed in claim 1, wherein said agitator drive shaft means extends into said vessel at an inclination to the vertical through said top opening of said container.

* * * * *